US009932704B2

(12) United States Patent
Lessley et al.

(10) Patent No.: US 9,932,704 B2
(45) Date of Patent: Apr. 3, 2018

(54) FLUID APPLICATION DEVICE, STRAND ENGAGEMENT DEVICE AND METHOD OF CONTROLLING THE SAME

(71) Applicant: Illinois Tool Works Inc., Glenview, IL (US)

(72) Inventors: Mel Steven Lessley, Villa Hills, KY (US); Edward Wayne Bolyard, Jr., Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 121 days.

(21) Appl. No.: 14/525,774

(22) Filed: Oct. 28, 2014

(65) Prior Publication Data

US 2015/0147461 A1 May 28, 2015

Related U.S. Application Data

(60) Provisional application No. 61/907,729, filed on Nov. 22, 2013.

(51) Int. Cl.
*D06M 23/00* (2006.01)
*B05B 13/02* (2006.01)
(Continued)

(52) U.S. Cl.
CPC ..... *D06M 23/00* (2013.01); *B05B 3/02* (2013.01); *B05B 13/0214* (2013.01);
(Continued)

(58) Field of Classification Search
CPC ..... B05C 5/0241; B05C 5/0245; B05C 13/00; B65H 57/16; B65H 57/04; B65H 2701/31; B05B 3/02; B05B 13/0214; D06M 23/00
(Continued)

(56) References Cited

U.S. PATENT DOCUMENTS 3,529,571 A * 9/1970 Good ..... B41F 17/10 118/219
3,997,128 A * 12/1976 Hara ..... B65H 54/2872 242/476.7
(Continued)

FOREIGN PATENT DOCUMENTS

EP 1176232 A1 1/2002
EP 1243347 A2 9/2002

OTHER PUBLICATIONS

International Search Report for PCT/US2014/065246 dated Feb. 5, 2015.
(Continued)

*Primary Examiner* — Laura Edwards
(74) *Attorney, Agent, or Firm* — Levenfeld Pearlstein, LLC

(57) ABSTRACT

A fluid application device, strand engagement device, and method of controlling the same are provided. The fluid application device includes an applicator head and a nozzle assembly. The nozzle assembly includes a guide slot configured to receive a strand of material and an orifice configured to discharge a first fluid on to the strand. The strand engagement device is secured to the applicator head and includes an actuating assembly and an engagement arm connected to the actuating assembly. The engagement arm is configured to engage the strand and move between a first position and a second position in response to actuation of the actuating assembly. The method of controlling the strand engagement device includes receiving an input signal including content, determining the content of the input signal and operating the strand engagement device in response to, and based on the content of, the input signal.

12 Claims, 8 Drawing Sheets

(51) Int. Cl.

| | |
|---|---|
| ***B05B 3/02*** | (2006.01) |
| ***B05D 1/02*** | (2006.01) |
| *B05C 13/00* | (2006.01) |
| *B05C 5/02* | (2006.01) |

(52) U.S. Cl.
CPC ..... *B05C 5/0241* (2013.01); *B05C 5/0245* (2013.01); *B05D 1/02* (2013.01); *B05C 5/027* (2013.01); *B05C 13/00* (2013.01)

(58) Field of Classification Search
USPC ..... 118/314, 325, 420, 428, 500; 425/463, 425/466; 156/62.4, 578
See application file for complete search history.

(56) References Cited

U.S. PATENT DOCUMENTS

| | | | | |
|---|---|---|---|---|
| 5,289,767 | A * | 3/1994 | Montalto | B65H 57/14 101/35 |
| 5,389,151 | A * | 2/1995 | Fort | B05C 5/027 118/411 |
| 6,001,178 | A | 12/1999 | Borgmann | |
| 6,361,634 | B1 | 3/2002 | White et al. | |
| 6,368,409 | B1 | 4/2002 | Borsuk et al. | |
| 6,540,831 | B1 | 4/2003 | Craine et al. | |
| 6,619,566 | B2 | 9/2003 | Gressett et al. | |
| 8,033,243 | B2 | 10/2011 | Bolyard | |
| 2002/0136833 | A1 | 9/2002 | Riney | |
| 2004/0164180 | A1 | 8/2004 | Harris et al. | |
| 2005/0274318 | A1 * | 12/2005 | Bolyard, Jr. | B05C 5/0241 118/325 |
| 2009/0000545 | A1 | 1/2009 | Bolyard et al. | |
| 2010/0024987 | A1 | 2/2010 | Saine et al. | |
| 2010/0025514 | A1 * | 2/2010 | Kipping | B21C 47/003 242/418 |
| 2012/0258246 | A1 | 10/2012 | Saine et al. | |

OTHER PUBLICATIONS

International Search Report for PCT/US2014/065250 dated Feb. 5, 2015.
International Search Report for PCT/US2014/065484 dated Mar. 19, 2015.

* cited by examiner

FLUID APPLICATION DEVICE, STRAND ENGAGEMENT DEVICE AND METHOD OF CONTROLLING THE SAME

BACKGROUND

The following description relates to a fluid application device for applying a fluid to a strand of material, and in particular, a fluid application device having a strand engagement device to position the strand relative to a nozzle assembly for applying the fluid to the strand.

Nonwoven fabrics are engineering fabrics that provide specific functions such as absorbency, liquid repellence, resilience, stretch, softness, strength, flame retardant protection, easy cleaning, cushioning, filtering, use as a bacterial barrier and sterility. In combination with other materials, nonwoven materials can provide a spectrum of products with diverse properties and can be used alone or as components of hygiene apparel, home furnishings, health care, engineering, industrial and consumer goods.

A plurality of elasticated strands may be positioned on and bonded to the nonwoven materials to, for example, allow for flexibility fitting around an object or a person. The strands may be bonded to the nonwoven fabric with an adhesive in the form of a glue fiber. In one configuration, the strands are fed past a nozzle on an adhesive application device. The nozzle may include a plurality of outlets through which the glue fiber may be discharged. A second fluid, such as air, may be discharged through separate outlets to control the application of the glue fiber such that the glue fiber is vacillated across the respective strands as the strands pass by the nozzle.

The strands may be fed from a strand supply, adjacent to the fluid application device and by the nozzle where the glue fiber may be applied. The strands pass by the nozzle at a predetermined distance for the glue to be discharged from the nozzle and applied to the strands. However, the fluid application device, and in particular, an applicator head which includes the nozzle, may operate at high temperatures to either melt the glue, or maintain the glue in a melted state for discharge from the nozzle. The applicator head may be at such a temperature that heat radiating from the applicator head, including the nozzle, may burn through or otherwise weaken or damage the strands when the strands are positioned at the predetermined distance from the nozzle for application of the glue onto the strands. This issue may arise during a static line condition, i.e., a condition where the strands are stationary. Positioning the strands at a distance greater than the predetermined distance during an active line condition may result is excess overspray of the glue (i.e., discharged glue not received on the strands), reducing efficiency and increasing material waste.

Accordingly, it is desirable to provide a fluid application device having a device that engages the strands to move the strands between a first position where the strands are sufficiently spaced apart from the fluid application device to prevent or limit burning or other heat damage to the strands during a static line condition and a second position where the strands are positioned sufficiently close to the nozzle for adequate adhesive application onto the strands during an active line condition.

SUMMARY

According to one embodiment, there is provided a fluid application device for coating a strand of material with a first fluid, the device having an applicator head, a nozzle assembly fluidly coupled to the applicator head, the nozzle assembly including a guide slot and an orifice through which a first fluid is discharged. The guide slot is configured to receive a strand of material and the orifice is configured to discharge the first fluid onto the strand. The fluid application device further includes a strand engagement device operably connected to the applicator head, the strand engagement device having an actuating assembly and an engagement arm connected to the actuating assembly. The engagement arm is configured to engage the strand and move between a first position and a second position in response to actuation of the actuating assembly so as to move the strand toward and away from the orifice.

According to another embodiment there is provided a strand engagement device for a fluid application device. The strand engagement device includes an actuating assembly and a strand engagement arm connected to the actuating assembly. The strand engagement arm is configured to engage at least one strand of material and move between a first position and a second position in response to actuation of the actuating assembly so as to move respective strands.

According to still another embodiment there is provided a method of controlling a strand engagement device of a fluid application device. The strand engagement device includes an actuating assembly and an engagement arm connected to the actuating assembly. The engagement arm is configured to engage at least one strand of material and move between a first position and a second position in response to actuation of the actuating assembly to move the at least one strand of material. The method includes receiving an input signal, the input signal including content, the content including an instruction to actuate the actuating assembly to move the engagement arm between the first position and the second position, or at least one of information regarding a line condition and information regarding a position of the engagement arm. The method further includes determining the content of the input signal, and operating the strand engagement device in response to, and based on the content of, the input signal.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
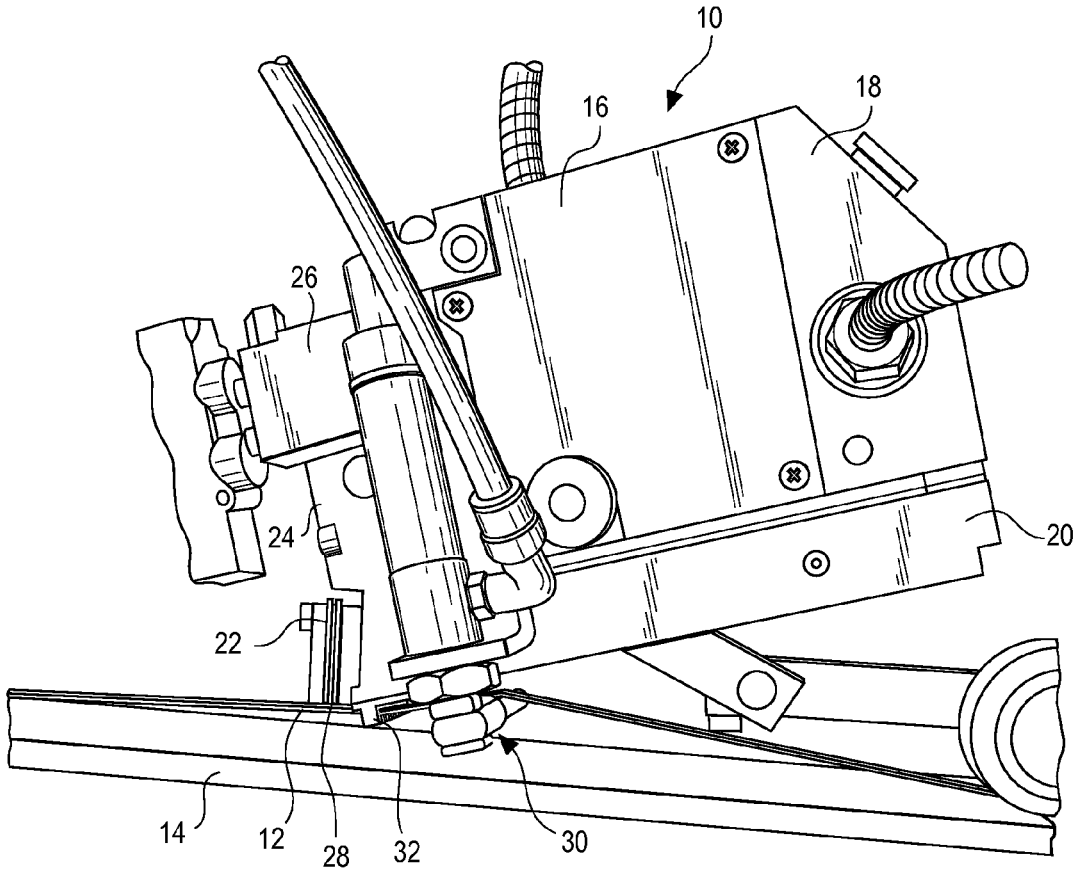
FIG. 1 is a side perspective view of a fluid application device having a strand engagement device according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a perspective view of a fluid application device 10 according to an embodiment described herein. The fluid application device 10 may be used to apply a first fluid on an article. The first fluid may be a viscous fluid that is a liquefied material heated or non-heated between 10 and 50,000 centipoise (cps). The first fluid may be, for example, an adhesive, and the article may be, for example, a strand 12 of material. That is, in one embodiment, the fluid application device 10 is part of a strand coating system. The adhesive may be applied to the strand 12 to adhere the strand 12 to a substrate 14, such as a nonwoven material. The strand 12 may be made from an elastic or non-elastic material and may be in either an elasticated (stretched) condition or a relaxed condition as the first fluid is applied. The strand 12 of material may be, for example, spandex, rubber or other similar elastic material.

According to one embodiment, the fluid application device 10 includes an applicator head 16. The applicator head 16 may include a first fluid supply unit 18, a second fluid supply unit 20 and a nozzle assembly 22. The first fluid supply unit 18 is configured to receive the first fluid from a first fluid source (not shown) and the second fluid supply unit 20 is configured to receive a second fluid from a second fluid source (not shown). The nozzle assembly 22 is fluidly coupled to, i.e., is in fluid communication with, the first fluid supply unit 18. The nozzle assembly 22 may also be fluidly coupled to, i.e., may be in fluid communication with, the second fluid supply unit 20. Accordingly, the nozzle assembly 22 may receive the first fluid from the first fluid supply unit 18 and the second fluid from the second fluid supply unit 20.

In some embodiments, the applicator head 16 may also include an adapter 24 secured to at least one of the first fluid supply unit 18 and second fluid supply unit 20. The adapter 24 is positioned adjacent to the nozzle assembly 22 and is fluidly coupled to, i.e., is in fluid communication with, the nozzle assembly 22. In addition, the adapter 24 is fluidly coupled to one of or both of the first fluid supply unit 18 and second fluid supply unit 20, such that the nozzle assembly 22 may receive the first fluid and the second fluid via the adapter 24. That is, the adapter 24 is in fluid communication with at least one of the first fluid supply unit 18 and the second fluid supply unit 20 and also the nozzle assembly 22. The adapter 24 is configured to have the nozzle assembly 22 secured thereto such that the nozzle assembly 22 may be properly positioned and oriented relative to the strands 12 and applicator head 16 for application of the first fluid onto the strands 12.

The applicator head 16 may also include a flow control module 26. The flow control module 26 may include a valve or series of valves to regulate a flow of the first fluid and second fluid from the first fluid supply unit 18 and second fluid supply unit 20, respectively, to the nozzle assembly 22. In some embodiments, the adapter 24 and flow control module 26 are implemented as the same unit. This unit provides an adhesive path between one of or both of the first and second fluid supply units 18, 20 and the nozzle assembly 22. This unit, i.e., the combined adapter 24 and flow control module 26 may also include valving to start and stop the flow of adhesive.

With further reference to FIG. 1, the nozzle assembly 22 may be secured to the applicator head 16, adapter 24 or other adjacent component of the applicator head 16. The nozzle assembly 22 may be formed as, for example, a non-contact nozzle assembly 22, but is not limited thereto. In a non-contact nozzle assembly, the first fluid is discharged from an orifice 28 over a gap to be received on the strand 12. That is, in a non-contact nozzle, the nozzle is spaced from the strand by a predetermined distance during the fluid application process. There may be at least one orifice 28 associated with each strand 12 of material. In some embodiments, there is one orifice 28 associated with each strand 12. That is, each orifice 28 may discharge the first fluid to a respective strand 12. Each orifice 28 may have a width of approximately 0.016-0.020 inches (in.), but is not limited thereto. For example, the width of the orifices 28 may be varied to accommodate different sizes of strands 12. In addition, in the non-contact nozzle, the second fluid may be discharged from at least one outlet adjacent to respective orifices 28 of the nozzle assembly 22. The second fluid may be used to control the application, or otherwise act on the first fluid to vary a discharge path of the first fluid during application onto the strand 12. For example, the second fluid may oscillate the first fluid as it is applied. Accordingly, the first fluid may be applied on the strand 12 in a desired pattern.

The first fluid may be an adhesive, such as a hot melt adhesive. The adhesive may be discharged from the orifice 28 as a filament or fiber to be applied on the strand 12. The first fluid may be discharged from the orifice 28 as a substantially continuous filament or fiber, but may be intermittently discontinuous so long as the first fluid is sufficiently applied to the strand 12 to allow the strand 12 to satisfactorily bond to the substrate 14. In some embodiments, the second fluid causes a discontinuous application of the first fluid onto the strand 12. The applicator head 16 may be heated to either melt the first fluid or maintain the first fluid in a melted condition. For example, the first fluid supply unit 18, the second fluid supply unit 20, and/or the nozzle assembly 22 may be heated, and thus, may also radiate heat outwardly. The applicator head 16 may also include a heater.

The second fluid may be, for example, air, and may be used to control or otherwise affect the discharge of the first fluid from the orifice 28 of the nozzle assembly 22 and onto the strand 12 as described above. In one embodiment, there are at least two outlets configured to discharge the second fluid adjacent to each orifice 28. It is understood, however, that the number of outlets associated with each orifice 28 may vary. For example, there may from one to six outlets associated with each orifice 28. The second fluid may be alternately discharged from the outlets adjacent to each orifice 28 to cause the first fluid to oscillate and be applied to the strand 12 in the desired pattern. In one embodiment, the first fluid may be applied to the strand 12 in a substantially sinusoidal pattern. However, the present disclosure is not limited to this application pattern. For example, the first fluid may be vacillated or oscillated by the second fluid such that the first fluid is applied in, for example, a repeated, non-repeated, irregular and/or asymmetrical pattern or patterns.

The fluid application device 10 further includes a strand engagement device 30. The strand engagement device 30 may be formed integrally with the applicator head 16. Alternatively, the strand engagement device 30 may be secured to the applicator head 16 or other component of the fluid application device 10 with a suitable fastener, including, but not limited to, bolts, screws, rivets, adhesives, welds and the like. The strand engagement device 30 is configured to engage the strands 12 and move the strands 12 toward or away from the applicator head 16 and nozzle assembly 22 based on a line condition (active or static) of the fluid application device 10, as discussed further below.

Figure 2:
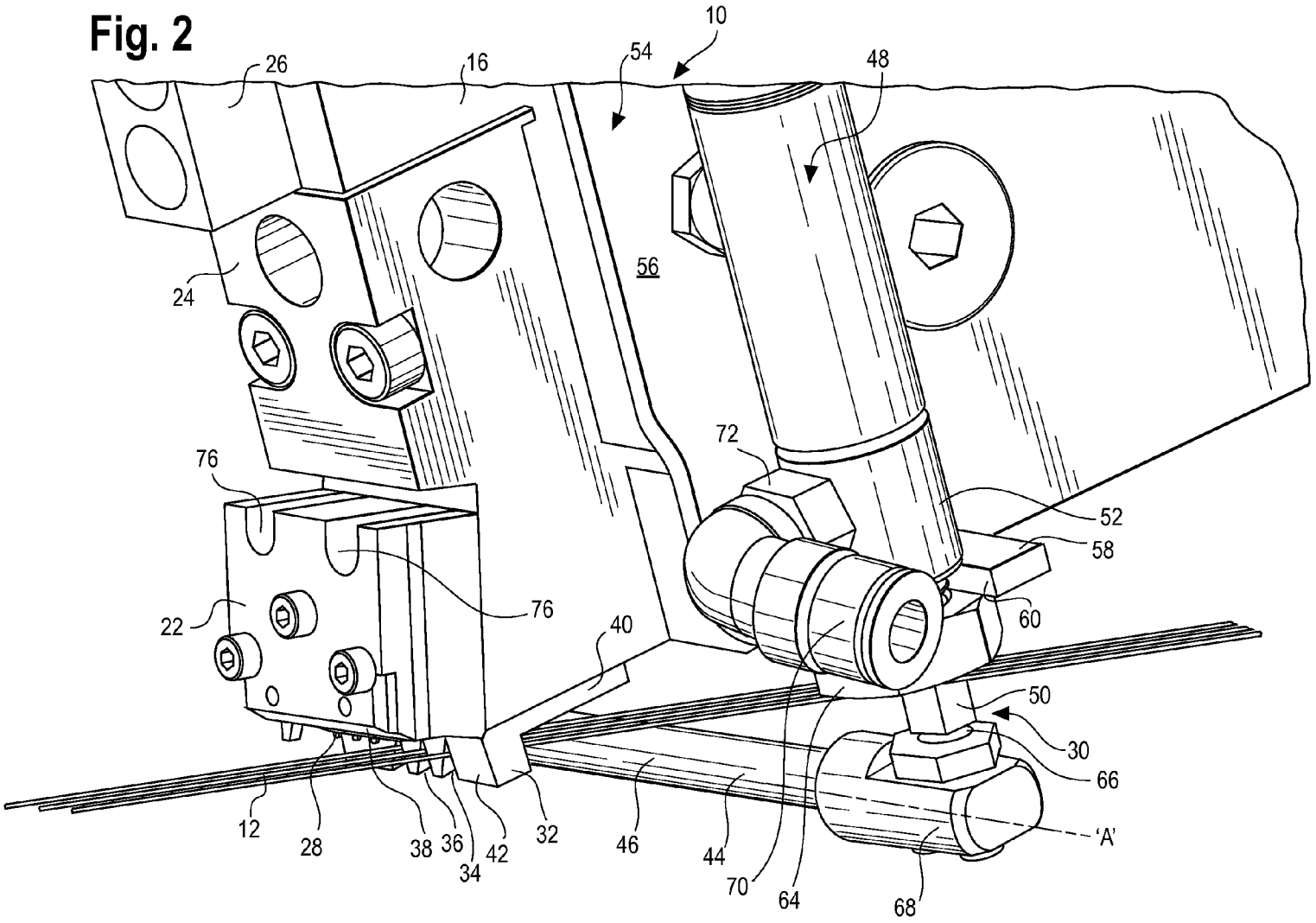
FIG. 2 is a perspective view of a fluid application device having a strand engagement device in a first position with a non-contact nozzle assembly according to an embodiment described herein.

FIG. 2 is a perspective view of the fluid application device 10 according to an embodiment described herein. As noted above, the nozzle assembly 22 may be formed as a non-contact nozzle. Referring to FIGS. 1 and 2, the non-contact nozzle assembly 22 includes a guide plate 32 to assist in positioning of the strands 12 relative to the orifices 28 and outlets. The guide plate 32 also includes at least one guide slot 34 through which the strand 12 may be fed. The guide slot 34 may be formed in a substantially inverted v-shape, with an open end 36 of guide slot 34 corresponding to a wide portion of the inverted v-shape, and a closed end 38 of the guide slot correspond to a narrow portion of the inverted v-shape. The closed end 38 may act as a limit or stop for the strands 12 to position the strands 12 at the desired position, or predetermined distance, relative the orifices 28 and outlets for application of the first fluid. That is, the closed end 38 may act as a stop to position the strand 12 a predetermined distance from the orifice 28. The strand 12 may either contact the closed end 38 or be positioned in close proximity to the closed end 38. The predetermined distance between the strand 12 and orifice is a distance or gap where overspray may be reduced or minimized. In a direction of travel of the strands 12, the at least one guide slot 34 may be spaced from, or positioned before the orifices 28 of the nozzle assembly 22.

According to one embodiment, the at least one guide slot 34 may include three guide slots 34. However, it is understood that the number of guide slots 34 may vary, and is not limited to the example above. Each guide slot 34 is associated with a corresponding orifice 28 of the nozzle assembly 22. That is, each guide slot 34 is substantially aligned with a corresponding orifice 28 of the nozzle assembly. For example, the closed end 38 of respective guide slots 34 may be aligned with respective orifices 28 in the direction of travel of the strands 12. Each guide slot 34 is configured to receive a separate strand 12, although it envisioned that more than one strand 12 may be received in each guide slot 34.

The guide plate 32 may be formed by a first flange 40 secured to the adapter 24 and a second flange 42 depending from the first flange 40. The at least one guide slot 34 may be formed in the second flange 42. The guide plate 32 may be secured to the adapter 24 using known fastening techniques.

With further reference to FIGS. 1 and 2, the strand engagement device 30 includes an engagement arm 44 configured to support and/or guide the strand or strands 12. The engagement arm 44 is adjustable to move the strands 12 into and/or within respective guide slots 34 to accurately position the strands 12 relative to the respective orifices 28 and outlets.

Figure 3:
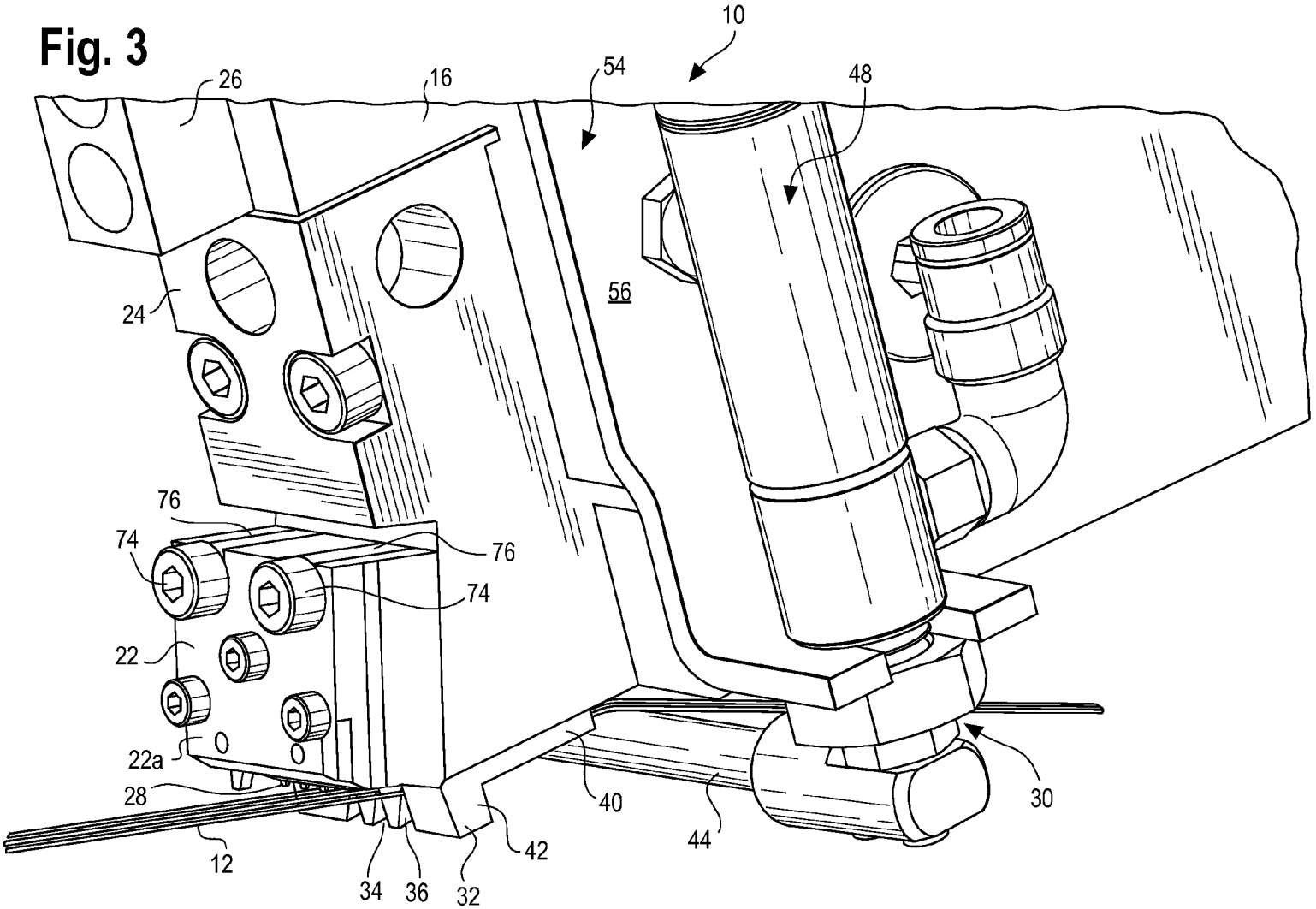
FIG. 3 is a perspective view of a fluid application device having a strand engagement device in a second position with a non-contact nozzle assembly according to an embodiment described herein.

FIG. 2 shows the engagement arm 44 in a first position. FIG. 3 is a perspective view of the fluid application device 10 with the engagement arm 44 in a second position. That is, the engagement arm 44 is adjustable between a first position, as shown in FIG. 2, and a second position, as shown in FIG. 3. The first position corresponds to a position where the engagement arm 44 is spaced a first distance from the applicator head 16. The first distance is sufficient to prevent or limit damage, such as burn through, to the strands 12 caused by heat radiating from the applicator head 16 and/or nozzle assembly 22. For example, the engagement arm 44, in the first position may space the strands 12 approximately 3-5 mm from a heat source of the applicator head 16 or nozzles assembly 22.

The second position corresponds to a position where the engagement arm 44 is spaced a second distance, less than the first distance, from the applicator head 16, such that the strands 12 are moved closer to the applicator head 16 and the respective orifices 28. In one example, the second position of the engagement arm 44 positions the strands approximately 1-3 mm from the orifices 28 of the respective nozzle assembly 22, and more preferably, 1-2 mm.

The engagement arm 44 also includes a contact surface 46 configured to engage the at least one strand 12. The contact surface 46 may be made from a non-stick material to reduce or minimize frictional contact with the at least one strand 12 as the at least one strand 12 is fed over the contact surface 46. Alternatively, or in addition, the contact surface 46 may be rotatable such that contact with the strands 12 causes the contact surface and/or the engagement arm 44 to rotate or roll about an axis 'A' defined by the engagement arm 44.

The strand engagement device 30 further includes an actuating assembly 48. The actuating assembly 48 may be operated to adjust the position of the engagement arm 44 relative to the applicator head 16. That is, the actuating assembly 48 is configured to move the engagement arm 44 between the first position and the second position. The actuating assembly 48 may be, for example, a pneumatically controlled piston 50 and cylinder 52. The piston 50 may be movable within the cylinder 52 in response to air or another gas being introduced into, or removed from, the cylinder 52. The piston 50 may be connected directly or indirectly to the engagement arm 44 such that movement of the piston 50 in and out of the cylinder 52 causes the engagement arm 44 to move toward or away, respectively, from the applicator head 16. Although the embodiments above are directed to an actuating assembly comprising pneumatically controlled piston and cylinder, it is understood that other actuating assemblies are envisioned as well. For example, the actuating assembly may be a direct-controlled solenoid that may be configured for selective reciprocating movement.

The strand engagement device 30 may further include a mounting bracket 54 configured to be secured to, or formed integrally with, the applicator head 16. The mounting bracket 54 may be used to secure the actuating assembly 48, and in turn, the engagement arm 44, to the applicator head 16 or other portion of the fluid application device 10. In one example, the mounting bracket 54 may be generally "L" shaped. The mounting bracket 54 may include a first leg 56 extending along the applicator head 16 and a second leg 58, extending outwardly from the first leg 56, away from the applicator head 16. The second leg 58 may include an opening 60, such as a slot, formed therein through which a portion of the piston 50 and/or cylinder 52 may extend. The mounting bracket 54 may be secured to the applicator head 16 with a suitable fastener, for example, one or more bolts, rivets, adhesive, snap or friction fit, mating components, welds, or other similar fasteners and/or combinations thereof. In one embodiment, the suitable fastener or fasteners may be received through, positioned on, or formed on the first leg 56. The fastener or fasteners may be received in corresponding bores (not shown) in the fluid application device 10.

According to an embodiment of the present invention, the actuating assembly 48 is mounted on the mounting bracket 54. For example, the cylinder 52 may be mounted on the mounting bracket 54. The cylinder 52 may include a threaded hollow projection 62 (FIG. 3) extending through the opening 60 of the second leg 58 of the mounting bracket 54. That is, the cylinder 52 may be positioned on and supported by the second leg 58 of the mounting bracket 54. A nut 64 or other similar threaded fastener may be positioned on the threaded projection 62 and tightened to secure the cylinder 52 on the mounting bracket 54 by way of a clamping force applied to the second leg 58 from the nut 64 and the cylinder 52.

The piston 50 is movably received within the cylinder 52. The piston 50 includes a first end (not shown) positioned within the cylinder 52 and a second end 66 extending from the cylinder 52. The second end 66 is secured to a proximate end 68 of the engagement arm 44 such that movement of the piston 50 causes movement of the engagement arm 44 between the first position and the second position. That is, the piston 50 moves together with the engagement arm 44 between the first position and the second position.

The engagement arm 44 may be secured to the piston 50 using a suitable fastening mechanism. For example, in one embodiment, the piston 50 may include a threaded portion received in an opening at the proximate end 68 of the engagement arm 44. At least one nut or other threaded fastener may be tightened on the threaded portion to secure the engagement arm 44 to the piston 50 thereon. It is understood that the present invention is not limited to this configuration however. For example, other fasteners may be used or an intermediate fastening device may be positioned between the second end 66 of the piston 50 and the proximate end 68 of the engagement arm 44. In one embodiment, the engagement arm 44 extends from the piston 50 at approximately 90 degrees, but is not limited thereto.

The actuating assembly 48 may further include at least one port 70 and at least one solenoid 72. In one embodiment, the at least one port 70 is in fluid communication with an interior of cylinder 52 to allow a fluid, such as air or another gas, to flow into the cylinder 52. The air may be received from, for example, a compressed air source (not shown). The solenoid 72 may function as a valve to control flow of the air into and/or out of the cylinder 52, thereby controlling motion of the piston 50 relative to the cylinder 52. As shown in FIGS. 2 and 3, the location of the port 70 relative to the nozzle assembly 22 may vary depending on a particular orientation at which the cylinder 52 is mounted on the mounting bracket 54.

The solenoid 72 may be either normally open or normally closed. In one embodiment, with the solenoid 72 normally open, compressed air may flow into the cylinder 52 to move the piston 50 against a biasing force. The biasing force may be provided by, for example, a coil spring (not shown) positioned within the cylinder 52. The compressed air may maintain the engagement arm 44 in either the first position or the second position depending on the relative configuration of the coil spring, piston 50, and port 70. Closing the solenoid 72 prevents or limits flow of compressed air into the cylinder 52 and allows the spring (not shown) to move the piston 50, and thus, the engagement arm 44 to the other of the first position or second position. With a normally closed solenoid 72, the spring maintains the piston 50, and thus, the engagement arm 44, in one of the first position or second position under the biasing force. The piston 50, and thus the engagement arm 44 is moved to the other of the first position or second position by opening the solenoid 72 to introduce compressed air into the cylinder 52, thereby moving the piston 50 against the biasing force. Air within the cylinder 52 may be vented from the cylinder 52 during movement of the piston 50 to the retracted position within the cylinder 52.

In a non-limiting embodiment, the first end (not shown) of the piston 50 includes a flange (not shown) or other end surface that sealingly and slidingly engages an inner periphery of the cylinder 52, thereby dividing an interior volume of cylinder 52 into a first chamber and a second chamber. The spring may be positioned in one of the first chamber or second chamber and abut the flange at the first end of the piston 50. The port 70 may introduce the compressed air into the other of the first chamber or the second chamber to cause the piston 50, via the flange, to act against the spring, such that the piston 50 moves within the cylinder 52.

Referring to FIG. 3, when the engagement arm 44 is moved from the first position to the second position, the piston 50 is moved to a retracted position within the cylinder 52. The engagement arm 44 moves with the piston 50 when the piston 50 is moved to the retracted position, and thus, moves toward the applicator head 16. With the strands 12 drawn across the engagement arm 44, the engagement arm 44 moves the strands 12 relative to, or within, respective guide slots 34 toward the respective closed ends 38. With the engagement arm 44 in the second position, the strands 12 are positioned relative to the orifices 28 at the second distance where the first fluid may be efficiently applied to the respective strands 12. Conversely, when the piston 50 is moved to the extended position (FIG. 2), the engagement arm 44 is moved away from the applicator head 16 to move the strands 12 away from the respective closed ends 38 of the guide slots 34.

Referring still to FIGS. 2 and 3, the nozzle assembly 22 may be formed as a modular unit. That is, the nozzle assembly 22 may be selectively removed from and secured to the fluid application device 10. For example, the nozzle assembly 22 may be selectively removed from and secured to the applicator head 16, and more specifically, in some embodiments, the adapter 24. Accordingly, the nozzle assembly 22 may be replaced in the event a newer or different nozzle assembly is desired or required. The nozzle assembly 22 is selectively removable from and securable to the fluid application device 10 by way of at least one securing element 74 (FIG. 3). In an exemplary embodiment, the nozzle assembly 22 includes at least one securing opening 76 extending therethrough, each securing opening 76 configured to receive a respective securing element 74.

With further reference to FIGS. 2 and 3, in one embodiment, the nozzle assembly 22 may include two securing openings 76, each configured to receive a respective securing element 74. It is understood that the number of securing openings 76 is not limited to the example above, however. Individual securing openings 76 may be formed as an opening or slot extending through the nozzle assembly 22. The opening or slot may be closed about its periphery or include an open side along an edge of the nozzle assembly 22. The securing elements 74 extend through the securing openings 76 and are received in corresponding bores (not shown) in the fluid application device 10 to secure the nozzle assembly 22 to the applicator head 16. This allows for a modular design of the fluid application device 10 and nozzle assembly 22.

Accordingly, the nozzle assembly 22 may be replaced without alternations to, or replacement of additional parts on, the fluid application device 10. In some embodiments, the non-contact nozzle assembly 22 shown in FIGS. 2 and 3 may be replaced with the contact nozzle assembly 22, as described below with reference to FIGS. 4 and 5, due to the modularity described above.

Figure 4:
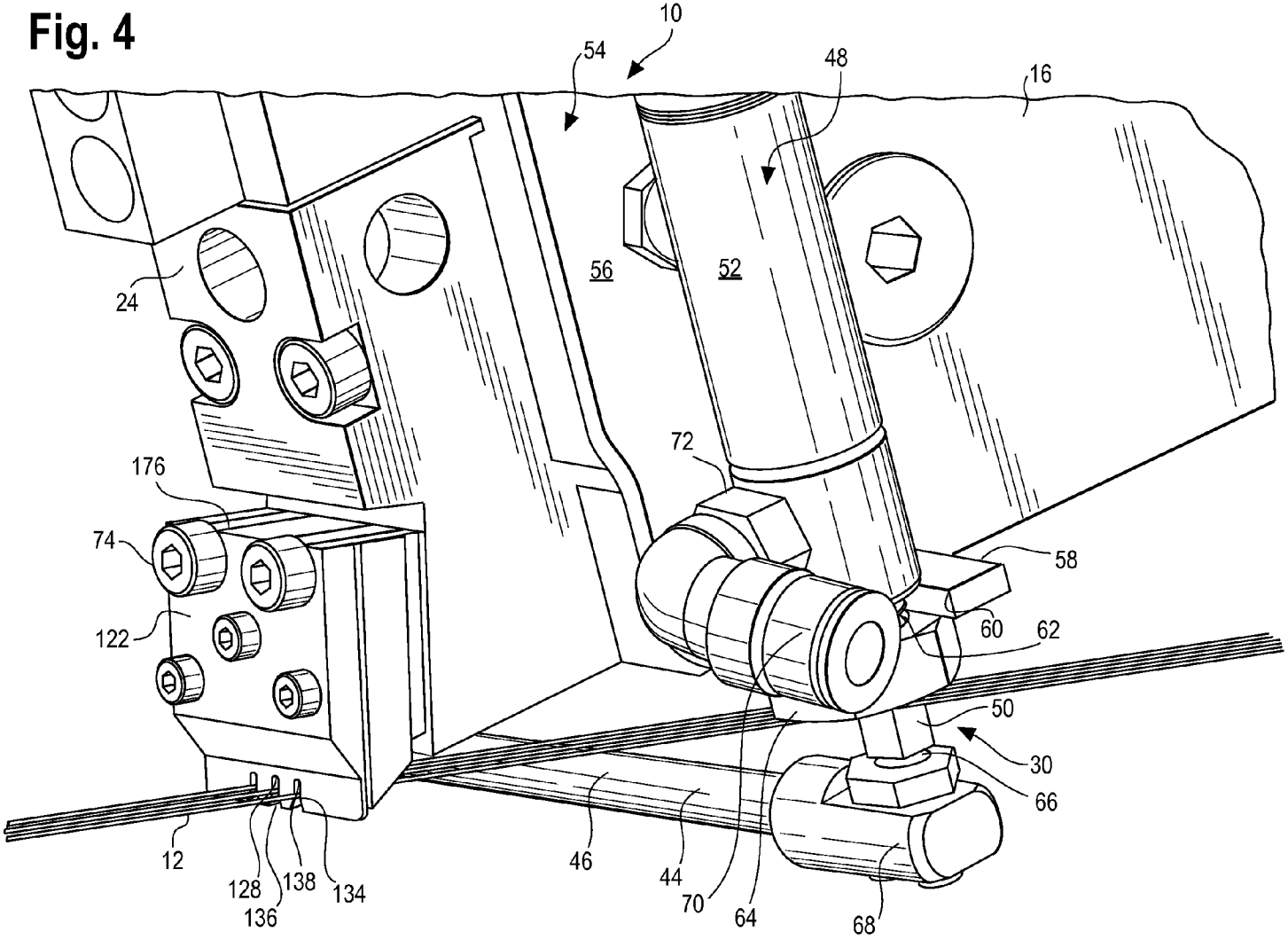
FIG. 4 is perspective view of a fluid application device having a strand engagement device in the first position with a contact nozzle assembly according to an embodiment described herein.

FIG. 4 is a perspective view of the fluid application device 10 with the strand engagement device 30 having a contact nozzle assembly according to an embodiment of the present invention. It is understood that features similar to those described above may be referred to with the same reference number as above. Further, it is understood, unless described differently or identified with a different reference number below, the features described above may be similar to those found in this example. As shown in FIG. 4, the fluid application device 10, and in particular, the applicator head 16, may be include a contact nozzle assembly 122 in place of the non-contact nozzle assembly 22 described above. The non-contact nozzle assembly 22 may be replaced with the contact nozzle assembly 122 by removing the securing elements 74 from the securing openings 76 of the nozzle assembly 22. The contact nozzle assembly 122 may be installed on the applicator head 16 by inserting the securing elements 74 through securing openings 176 of the contact nozzle assembly 122.

Figure 5:
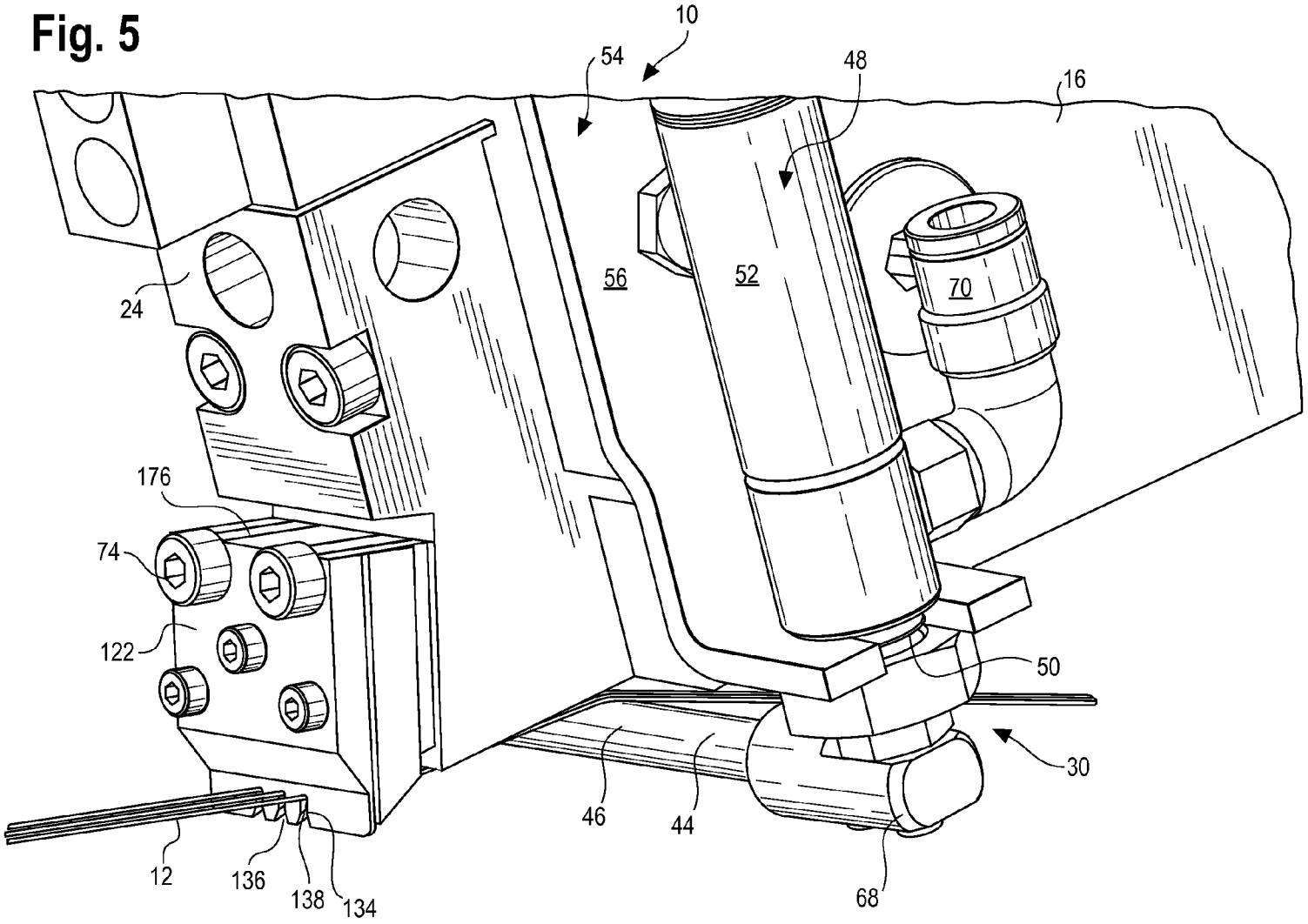
FIG. 5 is a perspective view of a fluid application device having a strand engagement device in the first position with a contact nozzle assembly according to an embodiment described herein.

The contact nozzle assembly 122 includes a guide slot 134 having an open end 136 configured to receive the strand 12 and a closed end 138. In one embodiment, the closed end 138 is positioned immediately adjacent to an orifice 128. The open end 136 of the guide slot 134 may include an inverted v-shaped portion. The guide slot 134 may have a substantially constant width between the inverted v-shaped portion and the closed end 138. An internal reservoir (not shown) is in fluid communication with the orifice 128. The internal reservoir receives a first fluid and the first fluid flows into the orifice 128. In the contact nozzle assembly 122, the first fluid is applied on the strand 12 by feeding the strand past, or at least partially within the orifice 128, such that the first fluid flowing from the internal reservoir into the orifice 128 may be applied directly on the strand 12. The contact nozzle assembly 122 may include more than one guide slot 134. For example, as shown in FIGS. 4 and 5, the contact nozzle 122 may include three guide slots. It is understood that other configurations with a different number of guide slots 134 are envisioned as well. Each guide slot 134 has a corresponding orifice 128 in fluid communication therewith. That is, a separate orifice 128 is associated with each guide slot 134.

FIG. 4 shows the strand engagement device 30 in the first position. The engagement arm 44 is spaced from the applicator head 16 and the orifice by the first distance where damage to the strands 12 caused by heat radiating from the applicator head 16 and/or contact nozzle assembly 122 is limited or prevented. In the first position, the strands 12 may be positioned in the guide slot 122 at a location spaced from the closed end 128 and the orifice 128.

FIG. 5 is a perspective view of fluid application device 10 with the engagement arm 44 of the strand engagement device 30 in the second position. To move the engagement arm 44 from the first position (FIG. 4) to the second position (FIG. 5), the piston 50 is moved to a refracted position within the cylinder 52. The engagement arm 44 moves with the piston 50 when the piston 50 is moved to the retracted position, and thus, moves toward the applicator head 16. With the strands 12 drawn across the engagement arm 44, the engagement arm 44 moves the strands within respective guide slots 134 toward the respective closed ends 138 and respective orifices 128. With the engagement arm 44 in the second position, the strands 12 are positioned immediately adjacent to or at least partially within the orifices 128 such that the strands 12 are in direct contact with the first fluid at respective orifices 128. Conversely, extending the piston 50 moves the strands 12 away from respective closed ends 138 of the orifices 128 of the nozzle assembly 122.

Figure 6:
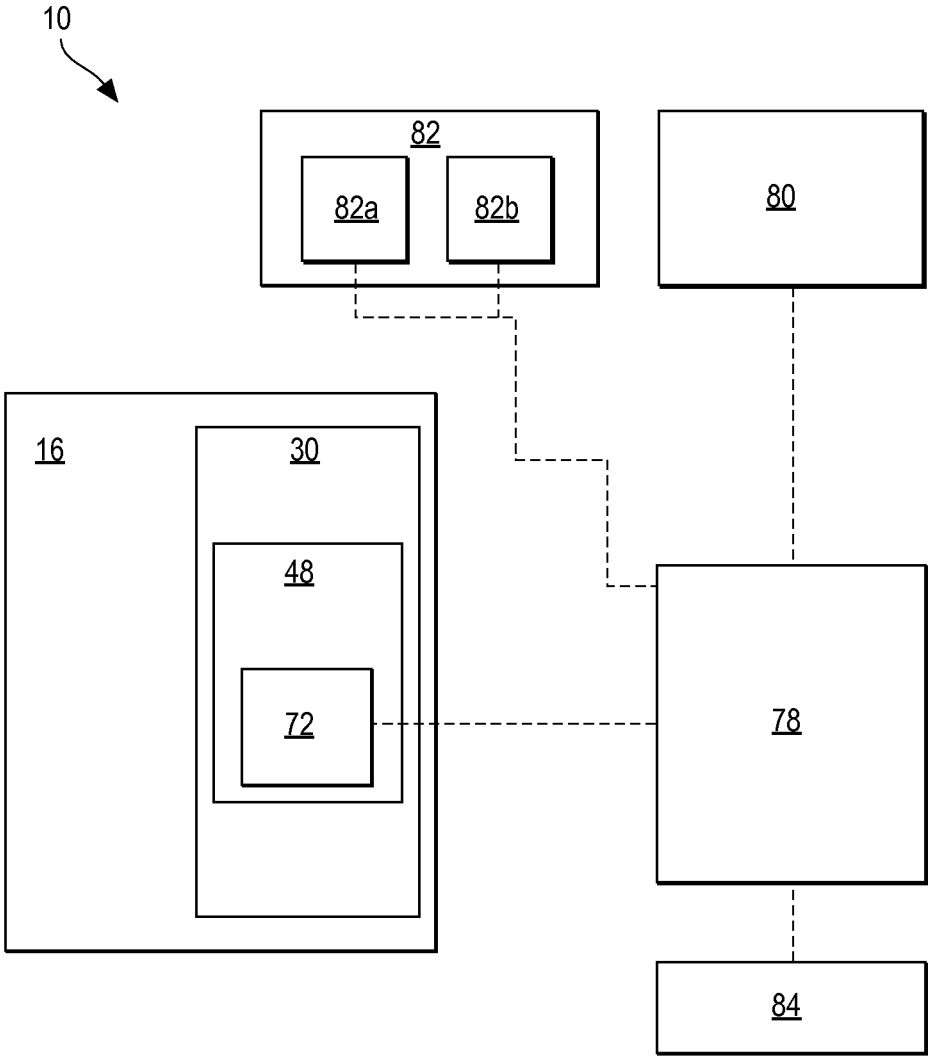
FIG. 6 is a schematic diagram of the fluid application device with a controller connected to the strand engagement device.

FIG. 6 is a schematic diagram of the fluid application device 10. Referring to FIG. 6, the fluid application device 10 may further include a controller 78. The controller may be implemented as part of the strand engagement device 30 or formed separately therefrom and be operably and communicably connected to the strand engagement device 30. The controller 78 may operate the strand engagement device 30, and in particular, the actuating assembly 48, to move the engagement arm 44 between the first position and the second position. The strand engagement device 30 may be operated in response to user input from an input/output (I/O) device 80 to the controller 78. Alternatively or in addition, as described further below, the strand engagement device 30 may be operated to move between the first position and second position in response to a change in the line condition. For example, in one embodiment, the engagement 44 is in the first position when the line is in static condition. When the line is placed into an active condition, where the strands 12 are being fed by the nozzle assembly 22, the strand engagement 44 may be moved into the second position. Conversely, when the line condition is changed from active to static, the strand engagement arm may be moved back to the first position. Movement of the strand engagement arm 44 between the first and second positions may be in response to a detected change in line condition using known sensors to detect movement of the strands or stand supply, or in response to actuation of a switch to control the line condition, for example.

In one embodiment, the controller 78 may be operably and communicably connected to the solenoid 72 to control motion of the piston 50 by controlling air flow through the port 70. That is, the solenoid 72 may be operated to control a pneumatic load on the piston 50, to move the piston 50 between the extended position and retracted position, corresponding to the first position and the second position, respectively, of the engagement arm 44.

In one embodiment, the controller 78 may also control the strand engagement device 30, and in particular, the strand engagement arm 44, in response to a signal or message received from at least one sensor 82. The at least one sensor is operably and communicably connected to the controller 78 and may be part of the fluid application device 10 or the applicator head 16. The signal may indicate, for example, a line condition and/or a current position of the engagement arm 44. In one embodiment, the line condition may be either static or active. "Static" refers to a condition where the line is not running and the strands are stationary. "Active" refers to a condition where the line is running and the strands are being fed through the modular nozzle assembly 22. The current position may be either the first position or the second position described above.

If the controller 78 determines, via content in the signal received from the at least one sensor that the line is in the static condition, and the engagement arm 44 is in second position, the controller 78 operates the solenoid 72 to move to a position allowing the engagement arm 44 to move to the first position. If the controller 78 determines, via content the signal received from the at least one sensor 82, that the line is in the static condition and the engagement arm 44 is in the first position, the controller 78 maintains the solenoid 72 in the current position so as to maintain the engagement arm 44 in the first position.

If the controller 78 determines, via content in the signal received from the at least one sensor 82, that the line is in an active condition and the engagement arm 44 is in the first position, the controller 78 operates the solenoid 72 to move to a position allowing the engagement arm 44 to move to the second position. If the controller 78 determines, via content in the signal received from the at least one sensor 82, that the line is in the active condition and the engagement arm 44 is in the second position, the controller 78 maintains the solenoid 72 in the current position so as to maintain the engagement arm 44 in the second position.

The at least one sensor 82 may include a sensor or sensors configured to detect a condition of the line, and an additional sensor or sensors configured to detect a position of the engagement arm 44. The at least one sensor 82 may be of a known type suitable for detecting movement and/or relative positions of various components as described above.

The controller 78 may be implemented as a microprocessor or computer having a microprocessor configured to execute program instructions stored in one or more computer-readable storage media, such as, but not limited to, a memory unit 84. Computer-readable storage media include non-transitory media, for example, magnetic media, including hard disks and floppy disks; optical media including CD ROM disks and DVDs, and/or optical disks. Computer-readable storage media may also include hardware devices configured to store and/or perform program instructions, including read-only memory (ROM), random access memory (RAM), flash memory and the like. It is understood that non-transitory media does not include signals or waves. The memory unit may be part of the controller 78, or a separate unit that is operably and communicably connected to the controller 78.

In the embodiments above, the strand engagement device 30 is configured to move the strands 12 between a position where the first fluid may be efficiently applied and a position where the strands 12 are sufficiently spaced from the applicator to prevent or limit damage to the strands 12 due to heat radiating from the applicator head 16 and/or nozzle assembly 22. The position of the strands 12 where the first fluid may be efficiently applied corresponds to the second position of the engagement arm 44. The position of the strands 12 where the strands 12 are sufficiently spaced from the applicator head 16 corresponds to the first position of the engagement arm 44.

The strand engagement device 30 is described in the examples above as being used for strand coating applications in a fluid application device 10 having a non-contact nozzle assembly 22 or a contact nozzle assembly 122. However, it is understood that a fluid application device 10 having the strand engagement device 30 described herein is not limited for use only with the nozzles described herein. The strand engagement device 30 may be implemented on fluid application devices having different contact and non-contact nozzle configurations where it may be beneficial to move strands toward and away from an applicator head depending on a line operating condition, e.g., static or active.

In operation, the fluid application device 10 may be in a static line condition. Accordingly, the engagement arm 44 may initially be in the first position, such that the strands are adequately spaced from the nozzle assembly 22 and applicator head 16 to prevent or limit burn through or other heat related damage to the strands. With the engagement arm in the first position, the piston 50 is in an extended position relative to the cylinder 52.

When the fluid application device 10 is switched to an active line condition, i.e., a condition where first fluid is to be applied to the strands 12, the controller 78 operates the strand engagement device 30 to move the engagement arm 44 from the first position to the second position. In one embodiment, the controller 78 actuates the solenoid 72 in response to the signal received from the at least one sensor 82. Alternatively, the solenoid 72, and in turn, the strand engagement device 30, may be operated manually via the I/O device 80.

Actuation of the solenoid 72 operates the actuating assembly 48, such that the piston 50 moves within the cylinder 52. In one embodiment, actuation of solenoid 72 controls flow of compressed air into or out of the cylinder 52 to pneumatically load or unload the piston 50 within the cylinder 52. Accordingly, the piston 50 may be retracted within the cylinder 52 to move the engagement arm 44 from the first position to the second position. In the second position, the strands 12 extending across the engagement arm 44 are positioned relative to the nozzle assembly so that the first fluid may be efficiently applied thereon. That is, the strands 12 may be positioned such that overspray is reduced or minimized, as compared to a configuration where the strands are spaced further from an orifice of a nozzle.

If the fluid application device 10 is switched to a static condition where the strands 12 are not fed by or through the nozzle assembly 22, 122, the engagement arm 44 may be moved from the second position to the first position to move the strands 12 away from the applicator head 16 and/or nozzle 22, 122. For example, the controller 78 may actuate the solenoid 72 to control air flow into or out of the cylinder 52 such that the piston 50 moves from the refracted position to the extended position, thereby moving the engagement arm 44 to the second position. In the second position, the strands 12 may be sufficiently spaced from the applicator head 16 and nozzle assembly 22, 122 to prevent or limit burn through or other heat related damage.

In the embodiments described above, the strands 12, with the engagement arm 44 in the second position, may be positioned approximately 1-3 mm from the respective orifices 28, and more preferably, 1-2 mm from respective orifices for application of the first fluid thereto. At this position, overspray of the first fluid may be reduced or minimized compared to other configurations where strands are spaced farther from the orifices. In addition, in the embodiments above, line speeds may run up to 700-1000 meters per minute (mpm) while still achieving suitable adhesive coating on the strands 12.

Figure 7:
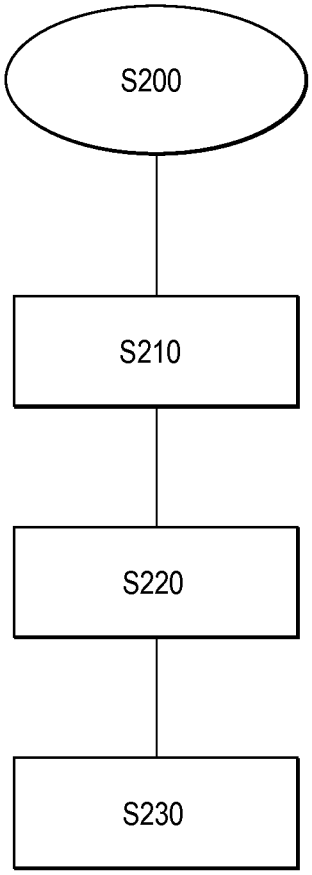
FIG. 7 is a diagram illustrating a method of controlling the strand engagement device of a fluid application device according to an embodiment described herein.

FIG. 7 is a diagram showing a method of controlling the strand engagement device 30 of the fluid application device 10 according to an embodiment of the present invention. In one embodiment of the present invention, the strand engagement device 30 and the fluid application device 10 are configured as described above. The method of controlling the strand engagement device 30 is shown generally at S200. At S210, the method includes receiving an input signal, the input signal including content, the content including an instruction to actuate the actuating assembly 48 to move the engagement arm 44 between the first position and the second position, or at least one of information regarding a line condition and information regarding a position of the engagement arm. At S220, the method includes determining the content of the received input signal. That is, at S220, it is determined whether the content of the received input signal is an instruction to actuate the actuating assembly 48 to move the engagement arm 44 between the first position and the second position, or at least one of information regarding a line condition and information regarding a position of the engagement arm 44. At S230, the method includes operating the strand engagement device 30 in response to, and based on the content of, the received input signal.

Figure 8:
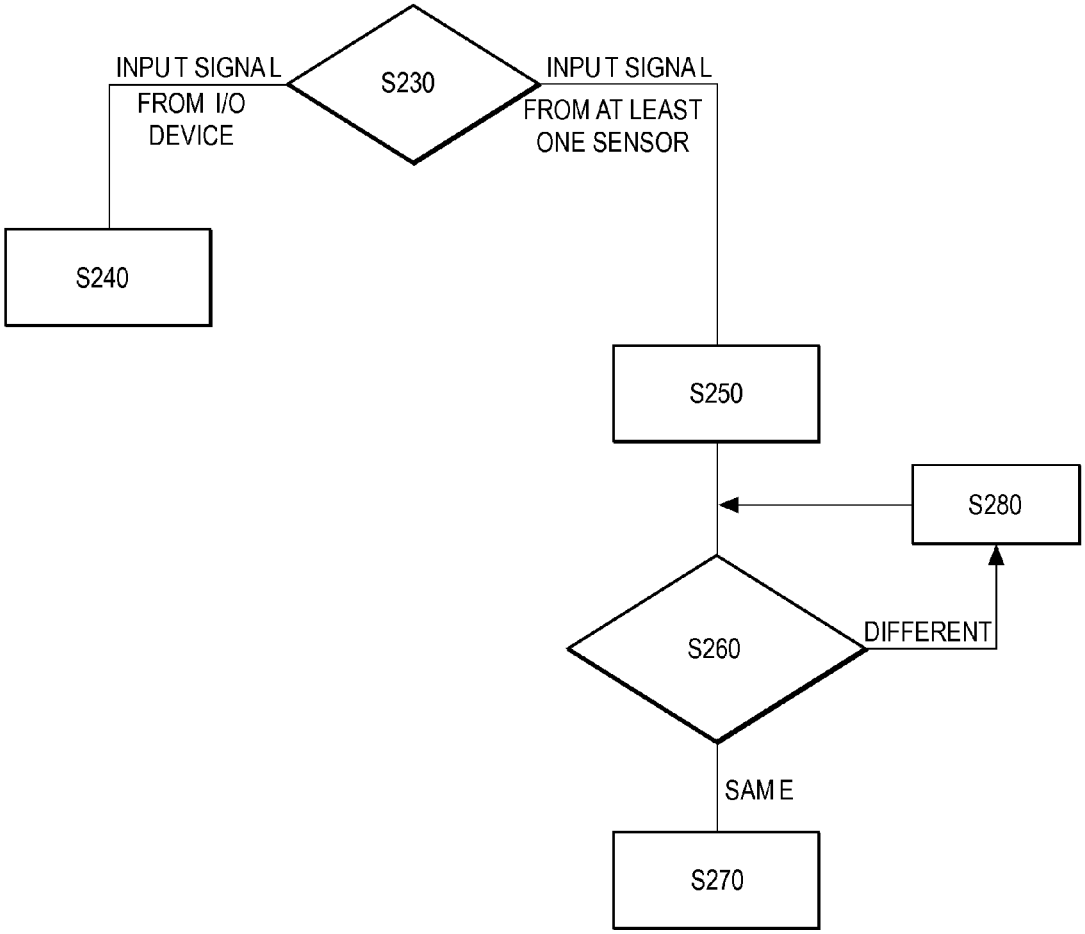
FIG. 8 is a diagram illustrating a method of operating the strand engagement device of the fluid application device according to an embodiment described herein.

FIG. 8 is a diagram showing the method S230 of operating the strand engagement device 30 of the fluid application device 10 according to an embodiment of the present invention. As noted above, the content of the input signal may include the instruction to actuate the actuating assembly 48 to move the engagement arm 44 between the first position and the second position. Here, the input signal may be received from the I/O device 80. At S240, the method of operating the strand engagement device 30 includes actuating the actuating assembly 48 to move the engagement arm 44 from the first position to the second position or from the second position to the first position. For example, a user or operator may use the I/O device 80 to generate the input signal having content including an instruction to actuate the actuating assembly 48. The user may do this when it is desired to move the engagement arm 44 from the first position to the second position or vice versa. The user may generate the input signal at the I/O device 80, for example, by actuating a switch or entering an input into the I/O device 80, for example, via a touch screen, keypad and/or keyboard.

The content of the input signal may alternatively include the information regarding a line condition and the information regarding a position of the engagement arm 44. Here, the input signal may be received from the at least one sensor 82, the at least one sensor 82 configured to detect the line condition and the position of the engagement arm. The information regarding the line condition may include, for example, a line condition detected by the at least one sensor 82. For example, the detected line condition could be "active" or "static" or other indicators or data that correspond to the active or static line conditions. The information regarding the position of the engagement arm 44 may include a detected position of the engagement arm 44, for example, "first position" or "second position," or other indicators or data that corresponds to the first and second positions.

The input signal may include a first input signal including the information regarding the line condition and a second input signal including information regarding the position of the engagement arm 44, and the at least one sensor 82 includes a first sensor 82*a* configured to detect the line condition and a second sensor 82*b* configured to detect the position of the engagement arm 44. The first input signal may be received from the first sensor 82*a* and the second input signal may be received from the second sensor 82*b*.

At S250, the method S230 includes comparing the information regarding the position of the engagement arm 44 to a desired position of the engagement arm 44 stored in, for example, the memory unit 84. The desired position of the engagement arm 44 is based on the information regarding the line condition. That is, the desired position of the engagement arm 44, e.g., the first position or the second position, may be based on the information regarding the line condition, e.g., active or static. For example, if the information regarding the line condition indicates a static line condition, the desired position of the engagement arm 44 may be the first position, and if the information regarding the line condition indicates an active line condition, the desired position of the engagement arm 44 may be the second position. The desired correlation between line conditions and desired engagement arm 44 positions may be stored at the memory unit 84.

At S260, the method includes operating the actuating assembly 48 based on a result of comparing the information regarding a position of the engagement arm 44 to a desired position of the engagement arm 44. At S270, operating the actuating assembly 48 includes maintaining the actuating assembly 48 in a position corresponding to the desired position of the engagement arm 44 when the information regarding the position of the engagement arm 44 indicates that the engagement arm 44 is the same position as the desired position of the engagement arm 44. At S280, operating the actuating assembly 48 includes actuating the actuating assembly 48 to move the engagement arm 44 to the desired position when the information regarding the position of the engagement arm 44 indicates that the engagement arm 44 is in a position different from the desired position of the engagement arm 44.

The method above may be stored in a non-transitory computer-readable storage medium including program instructions to implement various operations embodied by a computer. In one embodiment, the method may be carried out by the controller 78. The above method may be used to automatically adjust the position of the engagement arm 44 from the first position to the second position and vice versa based on a line condition (e.g., "static" or "active"). Accordingly, the engagement arm 44 may adjust a position of the strands 12 in to a desired position corresponding with a line condition of the fluid application device 10.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid application device for coating a strand of material with a first fluid, comprising:

an applicator head;

a nozzle assembly fluidly coupled and secured to the applicator head, the nozzle assembly comprising a guide slot and an orifice through which a first fluid is discharged, the guide slot configured to receive a strand of material and the orifice configured to discharge the first fluid onto the strand;

a strand engagement device operably connected to the applicator head, the strand engagement device comprising an actuating assembly and an engagement arm connected to and actuated by the actuating assembly, the engagement arm configured to engage the strand and move between a first position spaced a first distance from the nozzle assembly and a second position spaced a second distance from the nozzle assembly, the second distance being less than the first distance, in response to operation of the actuating assembly so as to move the strand toward and away from the orifice, wherein the actuating assembly comprises a cylinder and a piston slidably positioned therein and a distal end of the piston is connected to the engagement arm;

a controller configured to operate the actuating device to move the engagement arm between the first and second positions; and a sensor operably connected to the controller and configured to detect an active line condition where the strand is fed past the nozzle assembly and a static line condition where the strand is stationary, wherein, in response to the sensor detecting the active line condition with the engagement arm in the first position, the controller operates the actuating assembly to move the engagement arm to the second position, and in response to the sensor detecting a passive line condition with the engagement arm in the second position, the controller operates the actuating assembly to move the engagement arm to the first position.

2. The fluid application device of claim 1, further including a mounting bracket secured to the applicator head, and wherein the actuating assembly is attached to the mounting bracket.

3. The fluid application device of claim 1, wherein the engagement arm is formed of a non-stick material.

4. The fluid application device of claim 1, wherein the engagement arm is rotatable on an axis defined by the strand engagement arm.

5. The fluid application device of claim of claim 1, wherein the actuating assembly further comprises a solenoid valve operably and communicably connected to the controller.

6. The fluid application device of claim 1, wherein the nozzle assembly comprises more than one guide slot and more than one orifice, each guide slot configured to receive a respective strand of material and each orifice configured to discharge the first fluid onto a respective strand of material, wherein the engagement arm is configured to engage each strand of material.

7. The fluid application device of claim 1, wherein the nozzle assembly is a contact nozzle assembly.

8. The fluid application device of claim 1, wherein the nozzle assembly is a non-contact nozzle assembly.

9. A strand engagement and fluid application system comprising: a fluid application device comprising an applicator head and a nozzle assembly for discharging a fluid onto at least one strand of material and a strand engagement device comprising:

an actuating assembly coupled to the applicator head comprising a cylinder and a piston slidably positioned therein;

an engagement arm operably connected to and actuated by the actuating assembly at a distal end of the piston, the engagement arm configured to engage the at least one strand of material and move between a first position spaced a first distance from the nozzle assembly and a second position spaced a second distance from the nozzle assembly, the second distance being less than the first distance, in response to operation of the actuating assembly to move the at least one strand of material toward the nozzle assembly when moving the engagement from the first position to the second position and away from the nozzle assembly when moving the engagement arm from the second position to the first position, the engagement arm comprising a contact surface for engaging the at least one strand of material, the contact surface being cylindrical in shape, a controller operably connected to the actuating assembly to actuate the actuating assembly so as to move the engagement arm between the first position and the second position, and wherein in an active condition, the engagement arm is in the second position, the at least one strand is fed past the nozzle and the fluid is discharged from nozzle assembly for application onto the at least one strand.

10. The strand engagement device of claim 9, further including a mounting bracket for mounting the actuating assembly to the fluid application device.

11. The strand engagement device of claim of claim 9, wherein the actuating assembly is pneumatically loaded.

12. The strand engagement device of claim 11, further comprising a solenoid valve to control pneumatic loading and unloading of the actuating assembly.

* * * * *